US007270567B2

(12) United States Patent
Inoue

(10) Patent No.: US 7,270,567 B2
(45) Date of Patent: Sep. 18, 2007

(54) CONNECTOR HAVING AN ACTUATOR WHICH IS STABLY OPERABLE

(75) Inventor: Kanji Inoue, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/523,411

(22) Filed: Sep. 19, 2006

(65) Prior Publication Data

US 2007/0066127 A1 Mar. 22, 2007

(30) Foreign Application Priority Data

Sep. 20, 2005 (JP) ..... 2005-271993

(51) Int. Cl.
*H01R 12/24* (2006.01)

(52) U.S. Cl. ..... 439/495; 439/260; 439/329

(58) Field of Classification Search ..... 439/260, 439/495, 329

See application file for complete search history.

(56) References Cited

U.S. PATENT DOCUMENTS 4,718,859 A * 1/1988 Gardner ..... 439/329
7,077,691 B2 * 7/2006 Yokoo et al. ..... 439/495
2006/0107726 A1 * 5/2006 Heggemann et al. .... 72/409.14

FOREIGN PATENT DOCUMENTS

JP 3295808 6/2002

* cited by examiner

*Primary Examiner*—Truc Nguyen
(74) *Attorney, Agent, or Firm*—Collard & Roe, P.C.

(57) ABSTRACT

In a connector including first and second contacts having first and second contact points, respectively, an actuator is provided rotatable between a closed position and an open position and includes a cam portion faced to a connection object and a cutout portion adjacent to the cam portion. The first contact further has an engaging portion and a first beam portion elastically supporting the engaging portion to a housing. The engaging portion has a recess faced to the connection object and engaged with the cam portion. The second contact further has a contacting portion disposed at the cutout portion and a second beam portion elastically supporting the contacting portion to the housing. The contacting portion has a shape such that the contacting portion surrounds the cam portion in cooperation with the recess and biases the actuator towards the open position when the actuator is located near the open position.

10 Claims, 5 Drawing Sheets

CONNECTOR HAVING AN ACTUATOR WHICH IS STABLY OPERABLE

This application claims priority to prior Japanese patent application JP 2005-271993, the disclosure of which is incorporated herein by reference.

BACKGROUND OF THE INVENTION

This invention relates to a connector for connecting a connection object, such as a FPC (Flexible Printed Circuit) or a FFC (Flexible Flat Cable), to a substrate and, in particular, to a connector having a rotary actuator for pressing a connection object to a contact point of a contact.

A connector of the type is disclosed, for example, in Japanese Patent (JP-B) No. 3295808. The connector comprises a housing, a number of first and second contacts fixed to the housing, and an openable/closable actuator having opposite ends rotatably supported by the housing. The actuator has first cam portions and through holes adjacent to the respective first cam portions and corresponding to end portions of the first contacts. The actuator also has second cam portions (cutout portions) corresponding to end portions of the second contacts and a flat portion for pressing a FPC.

In the state where the actuator is opened, the FPC is inserted to the connector. Next, the actuator is rotated around the opposite ends rotatably supported by the housing. Then, the first cam portion presses the FPC. Therefore, a signal pattern of the FPC is connected to the first contacts. Since the second cam portion is pivotally supported by the second contacts, the flat portion of the actuator presses the FPC. Therefore, the signal pattern of the FPC is connected to second contact points of the second contacts.

In the above-mentioned connector, end portions of the second contacts have a simple rounded shape. Therefore, the actuator is not kept in a stable condition either at a closed position or an open position. Further, smooth rotation is difficult to achieve.

SUMMARY OF THE INVENTION

It is therefore an object of this invention to provide a connector having an actuator which can be kept in a stable condition either at a closed position or an open position.

It is another object of this invention to provide a connector having an actuator which can smoothly be rotated.

Other objects of the present invention will become clear as the description proceeds.

According to an aspect of the present invention, there is provided a connector to be connected to a connection object having first and second surfaces faced to each other in a first direction and inserted in a second direction perpendicular to the first direction, the connector comprising first contact including a first contact point to be contacted with the first surface of the connection object, a second contact including a second contact point to be contacted with the first surface of the connection object, a housing to which the first and the second contacts are fixed, and an actuator faced to the second surface of the connection object and rotatable between a closed position at which the actuator brings the first surface of the connection object into press contact with the first and the second contact points and an open position at which the press contact is released, the actuator including a cam portion faced to the second surface of the connection object and a cutout portion adjacent to the cam portion, the first contact further including an engaging portion with a recess which is faced to the second surface of the connection object and engaged with the cam portion and a first beam portion making the engaging portion be elastically held by the housing, the second contact further including a contacting portion faced to the second surface of the connection object and disposed at the cutout portion and a second beam portion making the contacting portion be elastically held by the housing, the contacting portion having a special shape such that the contacting portion surrounds the cam portion in cooperation with the recess and biases the actuator towards the open position when the actuator is located near the open position.

DESCRIPTION OF THE PREFERRED EMBODIMENTS

Figure 1A:
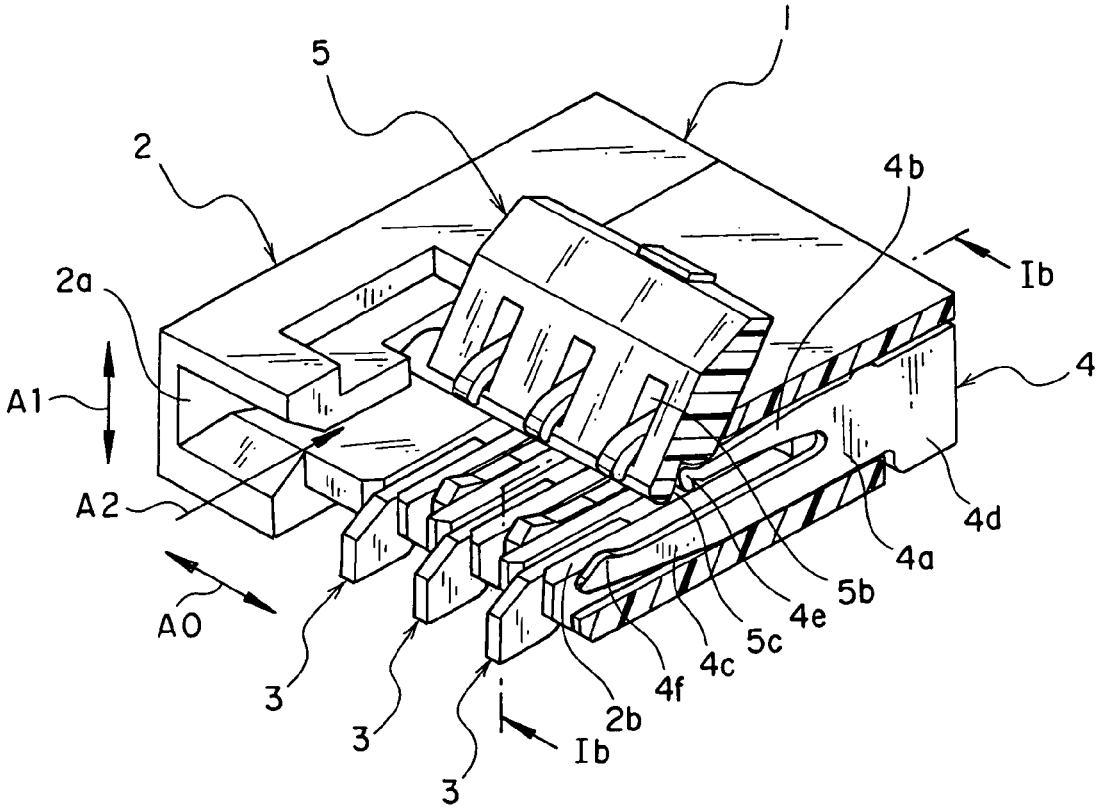
FIG. 1A is a half-section perspective view of a connector according to an embodiment of this invention.
Figure 1B:
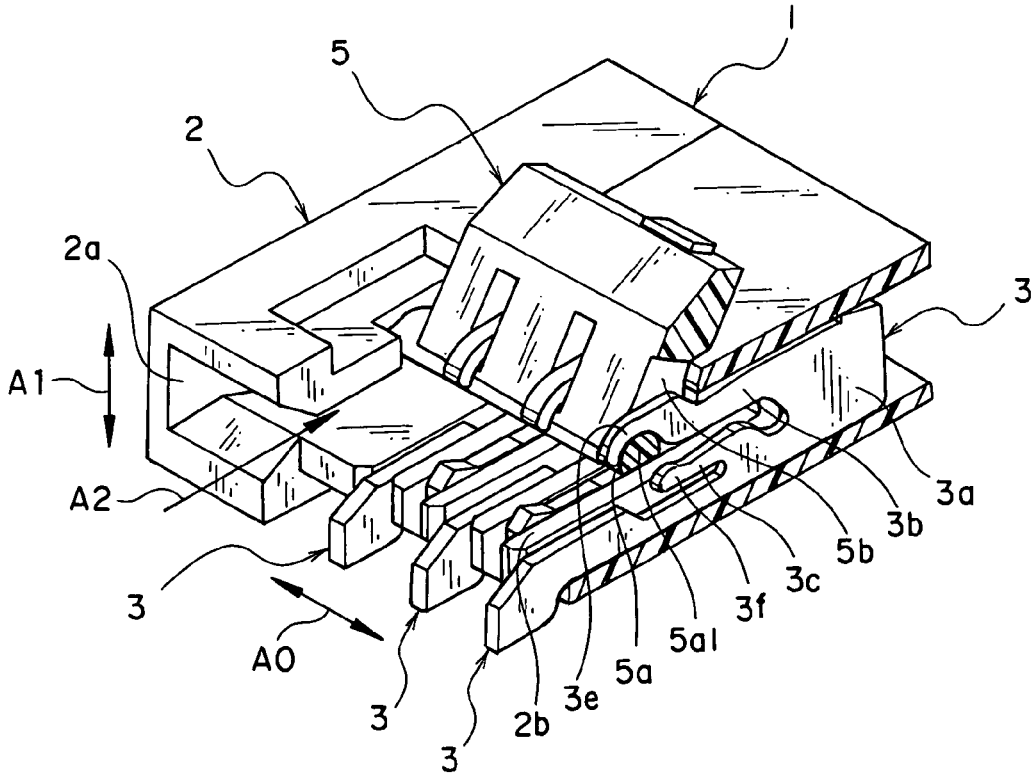
FIG. 1B is a sectional perspective view taken along a line lb-lb in FIG. 1A.
Figure 2:
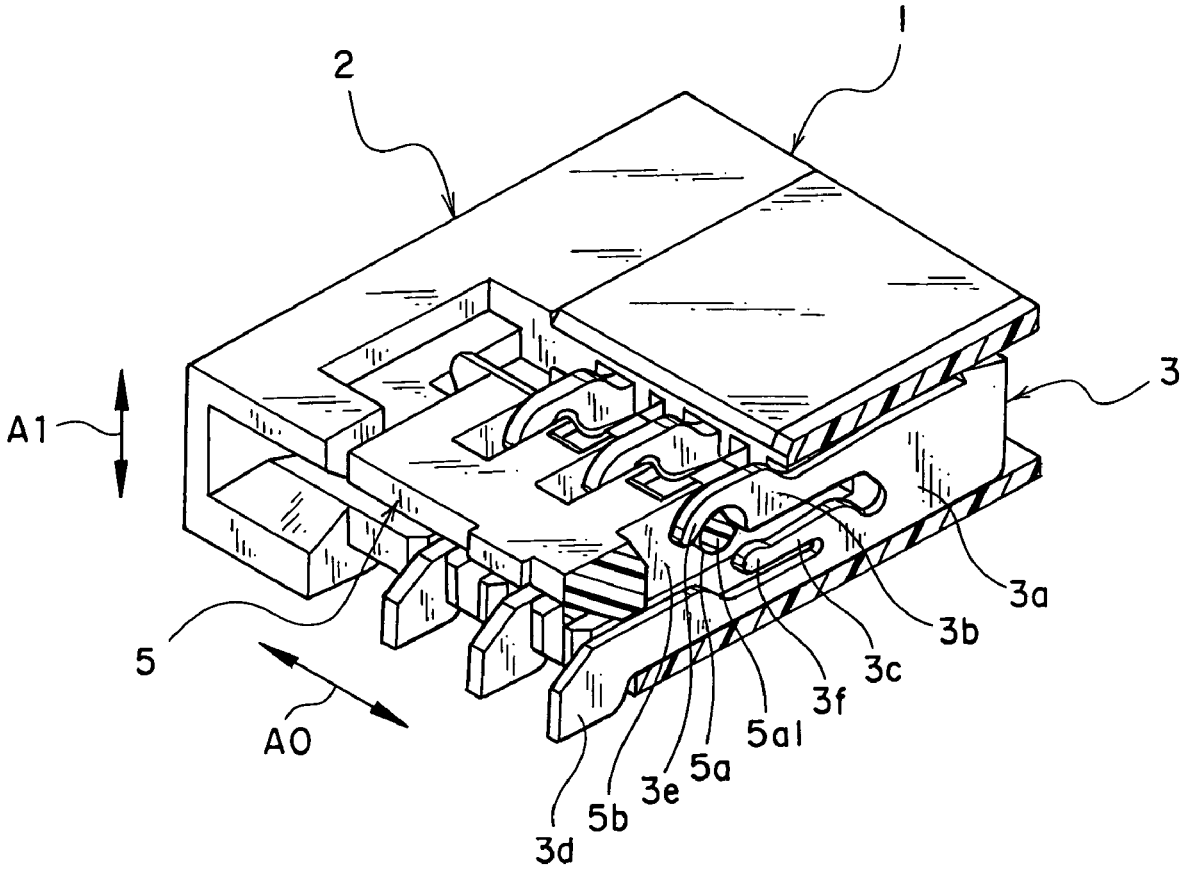
FIG. 2 is a sectional perspective view similar to FIG. 1B and showing a state after the connector in FIG. 1A is operated.

Referring to FIGS. 1A, 1B, and 2, description will be made of a connector according to an embodiment of this invention.

The connector depicted at 1 in the figure is a connector for connecting a connection object, such as a FPC or a FFC having a flat shape and flexibility, to a substrate. For convenience of description, the connection object will hereinafter be called the FPC. The connector 1 comprises an insulating housing 2, a number of conductive first contacts 3 fixed to the housing 2 and disposed at a predetermined pitch in a predetermined direction (transversal direction) A0, a number of conductive second contacts 4 disposed at a preselected pitch between every two adjacent ones of the first contacts 3, and an actuator 5 disposed at a front part of the housing 2 and supported by the first and the second contacts 3 and 4 to be rotatable between an open position illustrated in FIGS. 1A and 1B and a closed position illustrated in FIG. 2 In the following description, a vertical direction, i.e., a thickness direction of the housing 2 will be called a first direction A1 while a direction from front to back of the housing 2 will be called a second direction A2.

Each of the first contacts 3 has a base portion 3*a* held by the housing 2, and upper and lower beam portions 3*b* and 3*c* extending from the base portion 3*a* and elastically deformable. The upper and the lower beam portions 3*b* and 3*c* are faced to each other in the first direction A1 with a space left from each other. The base portion 3*a* is provided with a terminal portion 3*d* formed near its front end to be connected to a substrate (not shown). The upper beam portion 3*b* is provided with an engaging portion 3*e* formed at its front end and having a recess of a generally U shape in section. The lower beam portion 3*c* is provided with a first contact point 3*f* formed near its front end to be electrically connected to the FPC. Thus, the engaging portion 3*e* and the first contact point 3*f* are elastically held by the housing 2 via the upper and the lower beam portions 3*b* and 3*c*, respectively.

Each of the second contacts 4 has a base portion 4*a* held by the housing 2, and upper and lower beam portions 4*b* and 4*c* extending from the base portion 4*a* and elastically deformable. The upper and the lower beam portions 4*b* and 4*c* are faced to each other in the first direction A1 with a space left from each other. The base portion 4*a* is provided with a terminal portion 4*d* formed near its front end to be connected to the substrate. The upper beam portion 4*b* is provided with a contacting portion 4*e* formed at its front end and having a special shape which will later be described in detail. The lower beam portion 4*c* is provided with a second contact point 4*f* formed near its front end to be electrically connected to the FPC. Thus, the contacting portion 4*e* and the second contact point 4*f* are elastically held by the housing 2 via the upper and the lower beam portions 4*b* and 4*c*, respectively. The first contact points 3*f* and the second contact points 4*f* are arranged in two rows in the predetermined direction A0 and in a staggered or a zigzag pattern.

The actuator 5 has a plurality of cam portions 5*a* formed at positions in one-to-one correspondence to the engaging portions 3*e* of the first contacts 3, and a plurality of through holes 5*b* adjacent to the cam portions 5*b*. Each of the cam portions 5*a* has a shaft portion 5*a*1 having a generally semicircular section and serving as a rotation shaft of the actuator 5. The recess of the engaging portion 3*e* has a shape such that the recess is fitted over the shaft portion 5*a*1 to allow rotation of the shaft portion 5*a*1. When the actuator 5 is located near the open position, the contacting portion 4*e* surrounds the cam portion 5*a* in cooperation with the recess of the engaging portion 3*e*.

The actuator 5 is provided with a plurality of cutout portions 5*c* formed on one side of an end portion thereof in one-to-one correspondence to the contacting portions 4*b*1 of the second contacts 4. Each of the cutout portions 5*c* has an inner angle of about 90°. Thus, an inner bottom surface of the cutout portion 5*c* extends over two planes perpendicular to each other. The actuator 5 is provided with a flat portion 5*d* formed on the other side of the end portion to press the FPC.

The housing 2 has an insertion groove 2*a* to receive the FPC inserted therein. The insertion groove 2*a* extends in the predetermined direction A0 and the second direction (front-to-back direction) A2 and has a bottom surface defined by a support wall portion 2*b* of the housing 2.

In the state where the actuator 5 is at the open position as illustrated in FIGS. 1A and 1B, the FPC is inserted to the insertion groove 2*a* in the second direction A2. The FPC is supported and guided by the support wall portion 2*b* and is introduced between the first and the second contact points 3*f* and 4*f* and the actuator 5. The first and the second contact points 3*f* and 4*f* slightly protrude from the support wall portion 2*b* towards the insertion groove 2*a*.

After the FPC is inserted to the insertion groove 2*a*, the actuator 5 is rotated to the closed position as illustrated in FIG. 2. Then, the FPC is forced by the actuator 5 to be brought into press contact with the first and the second contact points 3*f* and 4*f*. As a result, the connector 1 is connected to the FPC.

Figure 3:
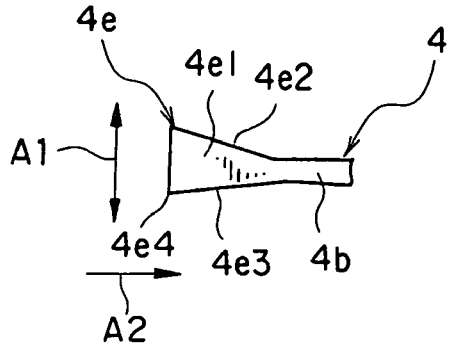
FIG. 3 is an enlarged side view of a characteristic part of the connector in FIG. 1A.

Now, referring to FIGS. 4A, 5A, and 6A in addition to FIG. 3, description will be made of the special shape of the contacting portion 4*e*. The special shape has a triangular section part 4*e*1 in which a dimension in the first direction A1 is symmetrically and gradually reduced towards the second direction A2. The triangular section part 4*e*1 has upper and lower surfaces as slant surfaces 4*e*2 and 4*e*3 inclined with respect to the first and the second directions A1 and A2.

In particular, the upper surface of the triangular-section part 4*e*1, i.e, the slant surface 4*e*2 is inclined to be gradually closer to the support wall portion 2*b* towards the second direction A2. As a result, when the actuator 5 is located near the open position as illustrated in FIG. 4A, the slant surface 4*e*2 is engaged with an edge 5*e* of the cutout portion 5*c* to bias the actuator 5 towards the open position.

Figure 6A:
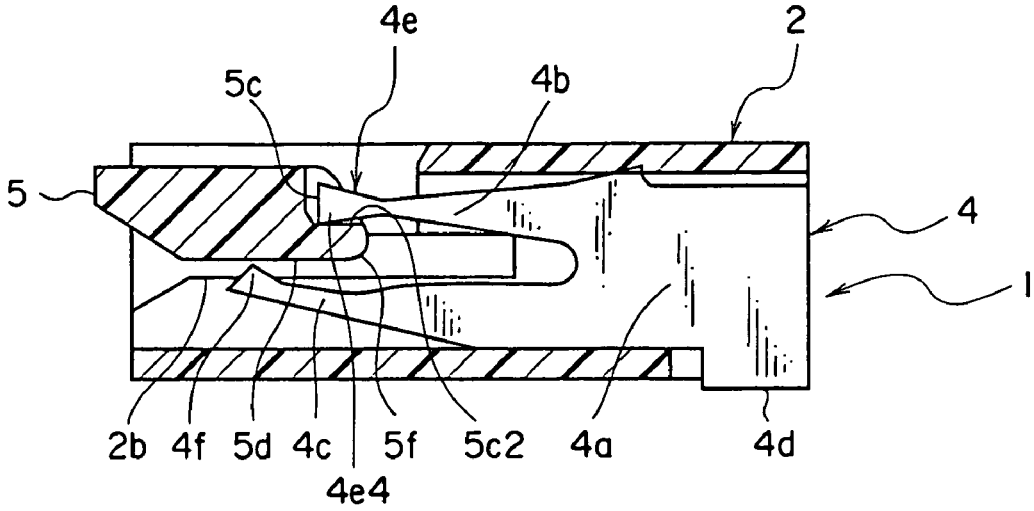
FIG. 6A is a sectional view similar to FIG. 4A after the connector in FIG. 1A is operated.

On the other hand, the lower surface of the triangular-section part 4*e*1, i.e., the slant surface 4*e*3 forms a protruding portion 4*e*4 to be engaged with the inner bottom surface of the cutout portion 5*c* when the actuator 5 is at the closed position as illustrated in FIG. 6A. Therefore, when the actuator 5 is at the closed position, the actuator 5 is prevented by the second contact point 4*f* and the protruding portion 4*e*4 from being moved in the first direction A1.

Figure 5B:
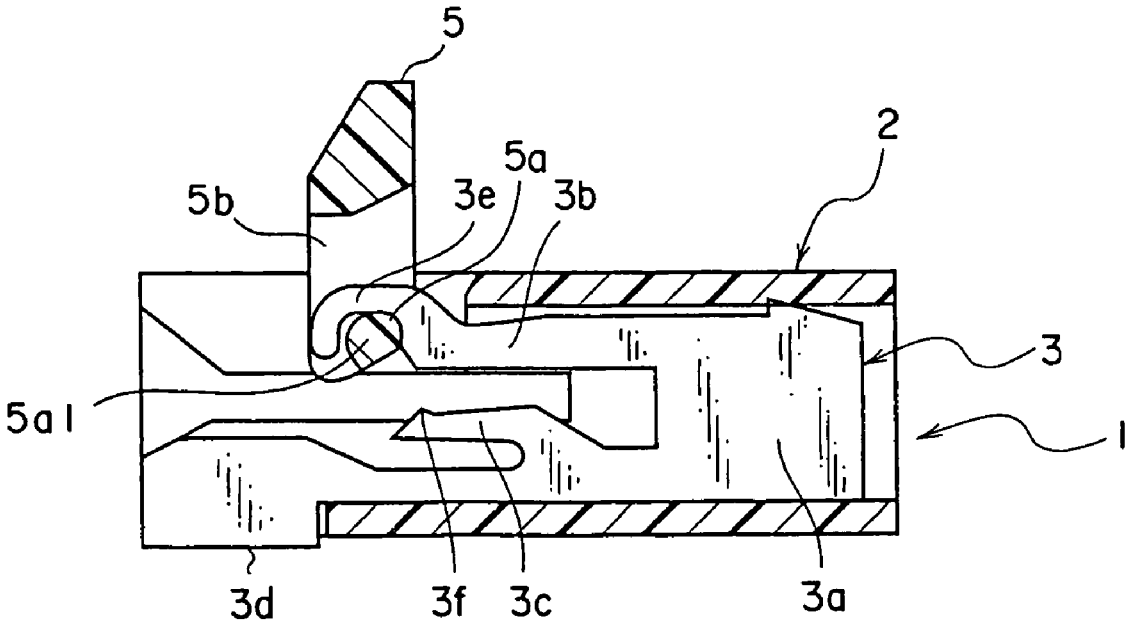
FIG. 5B is a sectional view similar to FIG. 4B while the connector in FIG. 1A is operated.
Figure 6B:
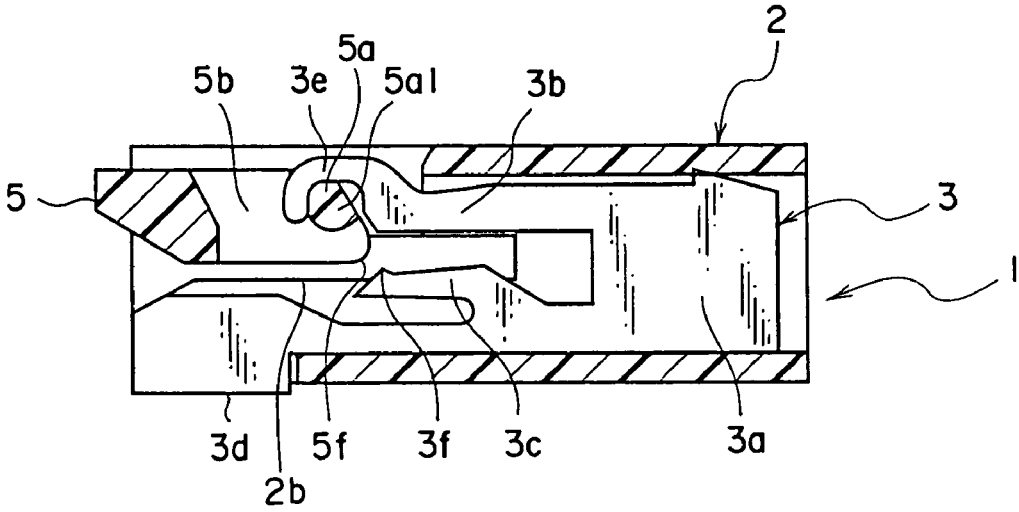
FIG. 6B is a sectional view similar to FIG. 4B after the connector in FIG. 1A is operated.

Next referring to FIGS. 4B, 5B, and 6B in addition, description will be made of a method of connecting the connector 1 and the FPC 10.

At first, the FPC 10 has a first surface or a lower surface 10*a* and a second surface or an upper surface 10*b* which are faced to each other in the first direction A1. The FPC 10 has a plurality of conductor patterns formed on the lower surface.

Figure 4A:
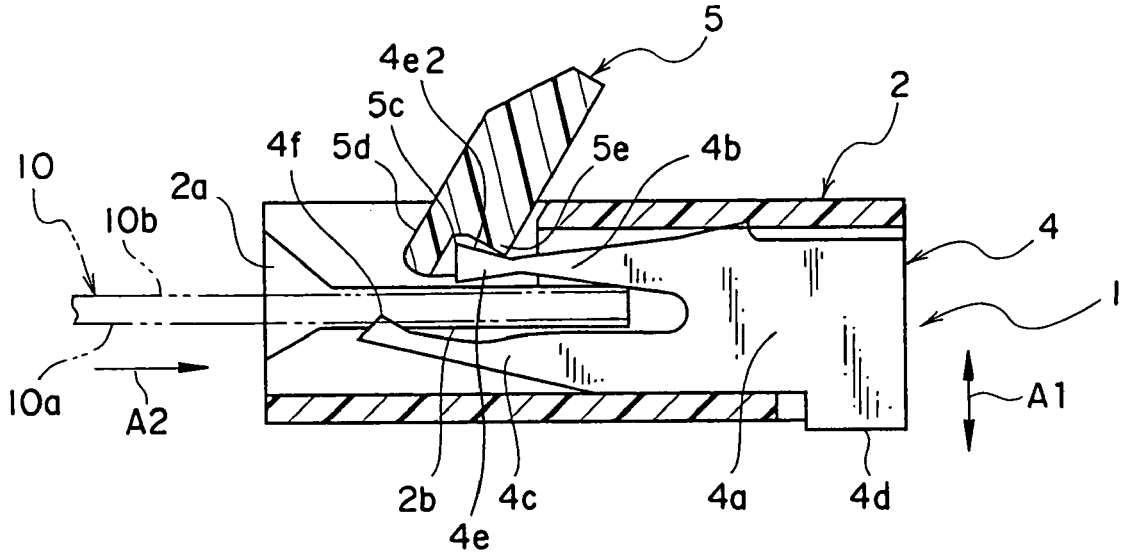
FIG. 4A is a sectional view of the connector in FIG. 1A at a section similar to that in FIG. 1A.
Figure 4B:
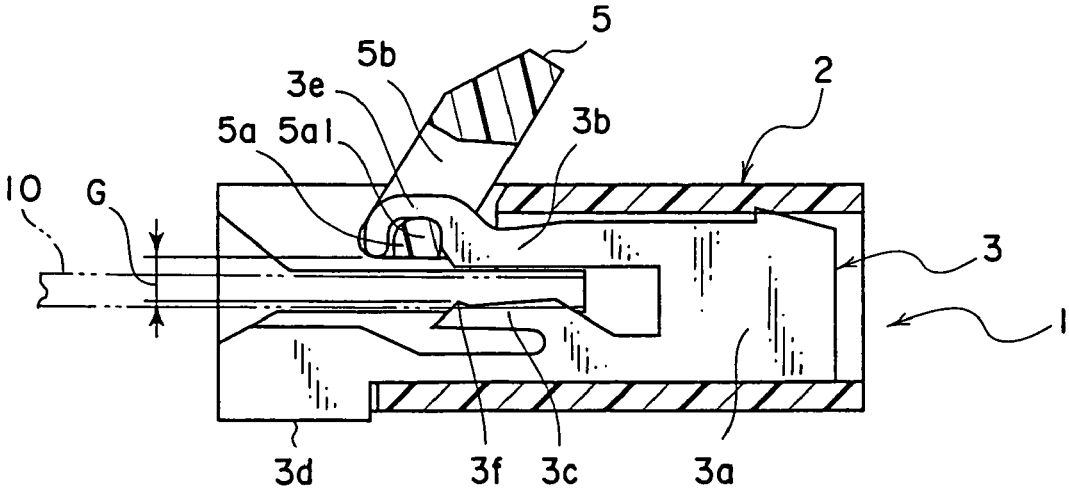
FIG. 4B is a sectional view of the connector in FIG. 1A at a section similar to that in FIG. 1B.
Figure 5A:
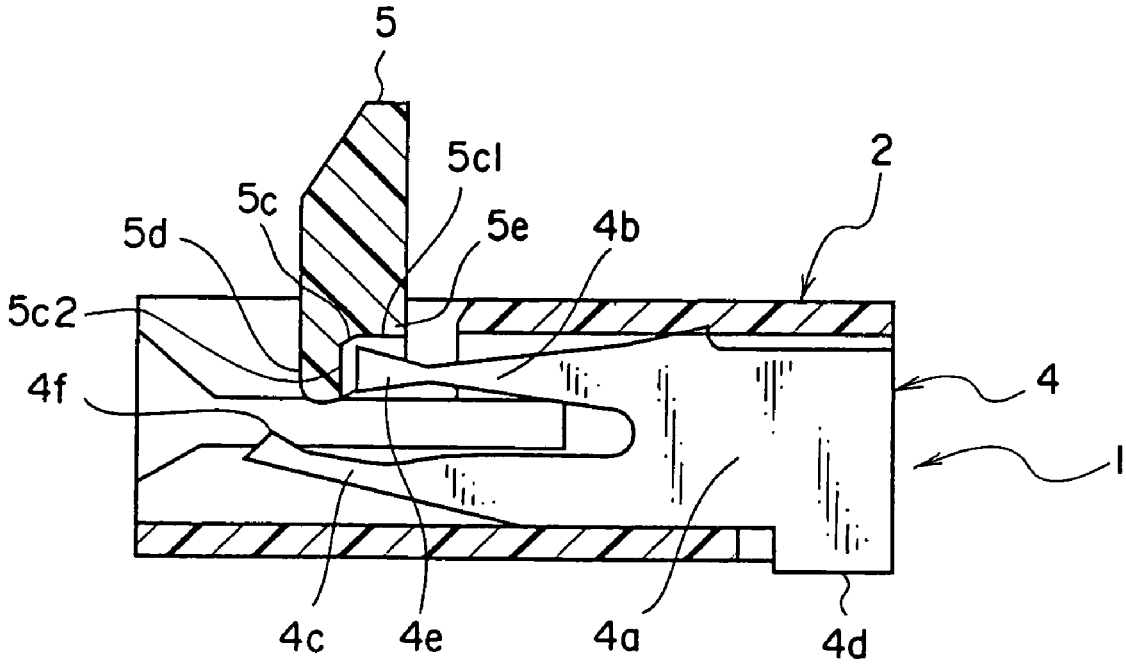
FIG. 5A is a sectional view similar to FIG. 4A while the connector in FIG. 1A is operated.

When the actuator 5 is at the open position as shown in FIGS. 4A and 4B, the FPC 10 is inserted to the connector 1. Next, the actuator 5 is rotated counterclockwise. Then, the actuator 5 passes a vertical position in FIGS. 5A and 5B and reaches a horizontal position in FIGS. 6A and 6B, i.e., the closed position. At the closed position, an end portion 5*f* of the actuator 5 enters into a gap G (see FIG. 4B).

When the actuator 5 is at the closed position, one surface 5*c*2 of the cutout portion 5*c* is brought into contact with the protruding portion 4*e*4 of the contacting portion 4*b*1. On the other hand, the cam portion 5*a* is rotatably supported by the engaging portion 3*e* of the first contact 3 and presses the FPC 10 downward. Therefore, some of the conductor patterns of the FPC 10 are brought into contact with the first contact points 3*f* of the first contacts 3, respectively. Since the cutout portion 5*c* is rotatably supported by the contacting portion 4*e* of the first contact 4, the flat portion 5*d* of the actuator 5 presses the FPC 10 downward. Therefore, the remaining ones of the conductor patterns of the FPC 10 are brought into contact with the second contact points 4*f* of the second contacts 4. The lower surface of the FPC 10 is supported by the support wall portion 2*b* of the housing 2.

Each of the contacting portions 4*e* of the second contacts 4 has a generally triangular section having a width widened towards its end. At least two surfaces of the contacting portion 4*e* are flat surfaces. Further, two surfaces 5*c*1 and 5*c*2 of each cutout portion 5*c* of the actuator 5 are flat surfaces. Therefore, the actuator 5 is reliably contacted with the contacting portion 4*e* at the open position and the closed position and is therefore kept in a stable condition.

Figure 7:
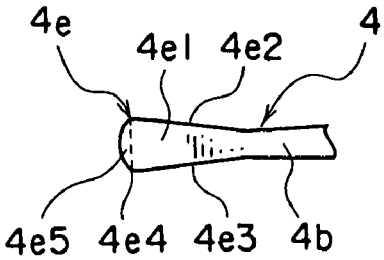
FIG. 7 is a side view of a modification of the characteristic part in FIG. 3.

As shown in FIG. 7, the special shape of the contacting portion 4*e* may have an arcuate protruding portion 4*e*5 of an arc-shaped section integrally formed on an end face of the triangular-section part 4*e*1 in a direction opposite to the second direction A2. Thus, the contacting portion 4*e* may have a generally fun-like section. In this case, rotation of the actuator 5 is smoothly carried out.

While the present invention has thus far been described in connection with a few embodiments thereof, it will readily be possible for those skilled in the art to put this invention into practice in various other manners. For example, the actuator may be formed so that its opposite ends are rotatably supported by the housing in addition to supporting by the contacts.

What is claimed is:

1. A connector to be connected to a connection object having first and second surfaces faced to each other in a first direction and inserted in a second direction perpendicular to the first direction, the connector comprising:

a first contact including a first contact point to be contacted with the first surface of the connection object;

a second contact including a second contact point to be contacted with the first surface of the connection object;

a housing to which the first and the second contacts are fixed; and an actuator faced to the second surface of the connection object and rotatable between a closed position at which the actuator brings the first surface of the connection object into press contact with the first and the second contact points and an open position at which the press contact is released;

the actuator including a cam portion faced to the second surface of the connection object and a cutout portion adjacent to the cam portion;

the first contact further including an engaging portion with a recess which is faced to the second surface of the connection object and engaged with the cam portion and a first beam portion making the engaging portion be elastically held by the housing;

the second contact further including a contacting portion faced to the second surface of the connection object and disposed at the cutout portion and a second beam portion making the contacting portion be elastically held by the housing;

the contacting portion having a special shape such that the contacting portion surrounds the cam portion in cooperation with the recess and biases the actuator towards the open position when the actuator is located near the open position.

2. The connector according to claim 1, wherein the contacting portion has a slant surface to be engaged with an edge of the cutout portion when the actuator is located near the open position.

3. The connector according to claim 2, wherein the slant surface is inclined with respect to the first and the second directions.

4. The connector according to claim 2, wherein the housing has a support wall portion for supporting the first surface of the connection object, the slant surface being inclined to be gradually closer to the support wall portion towards the second direction.

5. The connector according to claim 1, wherein the contacting portion has a protruding portion to be engaged with an inner surface of the cutout portion when the actuator is at the closed position.

6. The connector according to claim 5, wherein the actuator is prevented by the second contact point and the protruding portion from being moved in the first direction and prevented by the recess from being moved in the second direction when the actuator is at the closed position.

7. The connector according to claim 1, wherein the special shape has a triangular-section part in which a dimension in the first direction is symmetrically and gradually reduced towards the second direction.

8. The connector according to claim 7, wherein the special shape has an arcuate protruding portion of an arc-shaped section formed on an end face of the triangular-section part in a direction opposite to the second direction.

9. The connector according to claim 1, wherein the cam portion has a shaft portion having a generally semicircular section and serving as a rotation shaft of the actuator.

10. The connector according to claim 9, wherein the recess has a shape such that the recess is fitted over the shaft portion to allow rotation of the shaft portion.

* * * * *